US007028617B2

(12) United States Patent
Shibabuki et al.

(10) Patent No.: US 7,028,617 B2
(45) Date of Patent: Apr. 18, 2006

(54) PRINTING PLATE SUCKER

(75) Inventors: Tadanobu Shibabuki, Kanagawa (JP); Kazuoki Komiyama, Kanagawa (JP); Yoshinori Kawamura, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/730,059

(22) Filed: Dec. 9, 2003

(65) Prior Publication Data

US 2004/0112233 A1 Jun. 17, 2004

(30) Foreign Application Priority Data

Dec. 10, 2002 (JP) ..... 2002-358318
Jan. 31, 2003 (JP) ..... 2003-023020

(51) Int. Cl.
*B65H 5/08* (2006.01)
*B65H 5/22* (2006.01)

(52) U.S. Cl. ..... 101/477; 271/90; 271/103

(58) Field of Classification Search ..... 101/389.1, 101/477; 271/90, 107, 103; 294/64.1
See application file for complete search history.

(56) References Cited

U.S. PATENT DOCUMENTS 2,725,255 A * 11/1955 Watter ..... 294/64.1
2,815,240 A * 12/1957 Lytle ..... 294/64.1
2,850,279 A * 9/1958 Stoothoff et al. ..... 271/103
3,515,424 A * 6/1970 Sjodin ..... 294/64.1
3,724,687 A * 4/1973 Marschke et al. ..... 414/797
4,420,150 A 12/1983 Umezawa
4,564,188 A * 1/1986 McNair ..... 271/103
4,589,648 A 5/1986 Hancock
5,102,113 A 4/1992 Renner et al.
5,156,387 A * 10/1992 Seto ..... 271/20
6,254,089 B1 7/2001 Becker et al.

FOREIGN PATENT DOCUMENTS

DE 26 33 831 B1 1/1978
GB 674 844 A 7/1952
GB 712 031 A 7/1954
JP 2000-247489 A 9/2000

* cited by examiner

*Primary Examiner*—Leslie J. Evanisko
(74) *Attorney, Agent, or Firm*—Sughrue Mion, PLLC

(57) ABSTRACT

A printing plate sucker capable of stably suction-adhering and sheet-feeding both a printing plate and a protective sheet simultaneously without causing wrinkling at the protective sheet during the suction-adherence and sheet-feeding. The sucker is structured by a main body portion formed of a stiff body, a skirt portion formed of a resilient body, and a spring. When a moment from a printing plate acts on the sucker during sheet-feeding, the spring resiliently deforms. Thus, the main body portion is displaced (inclined) in the moment application direction, effective weight on the sucker is reduced, and a state in which a reduced moment acts on the sucker is achieved (the moment is substantially absorbed). Furthermore, the spring which redirects the moment is structured separately from the main body portion and skirt portion. Therefore, the sucker will not be deformed, an interleaf sheet will not be hoistingly deformed, and wrinkling will not occur.

6 Claims, 12 Drawing Sheets

$L_1 = L_2$ $W > W'$

PRINTING PLATE SUCKER

BACKGROUND OF THE INVENTION

1. Field of the Invention

The present invention relates to a printing plate sucker which simultaneously suction-adheres both of a printing plate and a protective sheet, which is superposed on an upper face of the printing plate, from the protective sheet side thereof and sheet-feeds the same.

2. Description of the Related Art

Technology (printing plate exposure devices) has been developed which, using a printing plate at which a recording layer (photosensitive layer) is provided on a support (for example, a PS plate, a thermal plate, a photopolymer plate or the like), records an image at the photosensitive layer (an image formation surface) of this printing plate with a direct laser beam or the like. With such technology, rapid image recording on printing plates is enabled.

Now, in a printing plate automatic exposure device which uses this technology for image recording onto printing plates, a large number of printing plates are stacked and accommodated in a cassette. The image-recording formation surfaces of the printing plates are easily damaged. In order to protect these image formation surfaces, protective sheets (interleaf sheets) are superposed with the image formation surfaces of the printing plates. These are stacked in successive layers and accommodated in the cassette. At a time of sheet-feeding the printing plates, one end portion of a topmost printing plate of the plurality of printing plates that are stacked in the cassette is suction-adhered by a sucker and separated from the other printing plates. Thus, the printing plates are taken out one by one and sheet-fed (conveyed and supplied) to a subsequent process (for example, an exposure process) while being inverted (see, for example, Japanese Patent Application Laid-Open (JP-A) No. 2000-247489).

Anyway, when printing plates are suction-adhered to be taken out one at a time and sheet-fed while being inverted as described above, besides a force on the sucker in a perpendicular direction (a load from the printing plate), a moment caused by this load acts on the sucker at a sucker suction position (a lifting position). In the case of a conventional, ordinary rubber sucker, the whole of the sucker is a resilient body of rubber or the like. Therefore, when this moment acts, the sucker itself (a skirt portion thereof) deforms in accordance with the moment, and the printing plate inclines with respect to an axial direction (the perpendicular direction) of the sucker (i.e., a position of loading effect is displaced with respect to the sucker). As a result, a state in which the moment is reduced is attained. Thus, the moment acts such that a practical limit of suction capability is increased, and suction-adherence and sheet-feeding of the printing plates is not hindered (ordinarily, a perpendicular component of a suction force of the sucker is stronger than the moment).

However, for this kind of printing plate automatic exposure device, in recent years, providing the protective sheets with slight permeability to air has been considered (see, for example, Japanese Patent Application No. 2001-378460 submitted by the present applicant). Hence, both the printing plate and the protective sheet, which is superposed with the printing plate, are simultaneously suction-adhered and sheet-fed as a pair, using the sucker from the protective sheet side thereof. The purpose of this is to shorten a sheet-feeding cycle time, simplify a sheet-feeding structure, reduce space requirements of the sheet-feeding structure, and to lower costs and the like.

In the case of a conventional, ordinary rubber sucker, when the sucker itself is deformed by the moment that acts during the suction-adherence and sheet-feeding as described above, there is a possibility that the protective sheet superposed with the printing plate will be hoistingly deformed, and wrinkling may occur. When wrinkling is caused in this manner at the protective sheet during suction by the rubber sucker, an air leak is formed between the protective sheet and the printing plate, and it becomes impossible to suction-adhere and sheet-feed the printing plate and the protective sheet together at the same time.

SUMMARY OF THE INVENTION

In consideration of the circumstances described above, an object of the present invention is to provide a printing plate sucker which is capable of stably suction-adhering and sheet-feeding both a printing plate and a protective sheet at the same time, without causing wrinkling at the protective sheet during the suction-adherence and sheet-feeding.

In order to achieve the object described above, according to a first aspect of the present invention, a double suction-type sucker which suction-adheres a printing plates is provided, a protective sheet including a predetermined porosity being interposed between the sucker and the printing plate, and the sucker including: a mounting base portion; a main body portion disposed downward of the mounting base portion; a skirt portion attached at a lower portion of the main body portion and capable of closely corresponding with the protective sheet for suction-adherence of the printing plate; and a joining structure which joins the mounting portion with the main body portion, the joining structure converting a moment which acts on the main body portion and the skirt portion during a suction-adherence operation to two intersecting force components for reducing deformation of the main body portion and preventing relative movement between the protective sheet and the printing plate.

According to a second aspect of the present invention, a double suction-type sucker which suction-adheres a printing plate is provided, a protective sheet including a predetermined porosity being interposed between the sucker and the printing plate, and the sucker including: a main body portion integrally including a mounting base portion and including a suction-adherence surface; and a skirt portion attached at the suction-adherence surface side of the main body portion and capable of closely corresponding with the protective sheet for suction-adherence of the printing plate, wherein the main body portion includes a predetermined stiffness for reducing deformation of the main body portion, which deformation is based on an external force that acts on the main body portion and the skirt portion during a suction-adherence operation, and preventing relative movement between the protective sheet and the printing plate.

DETAILED DESCRIPTION OF THE INVENTION

Figure 1:
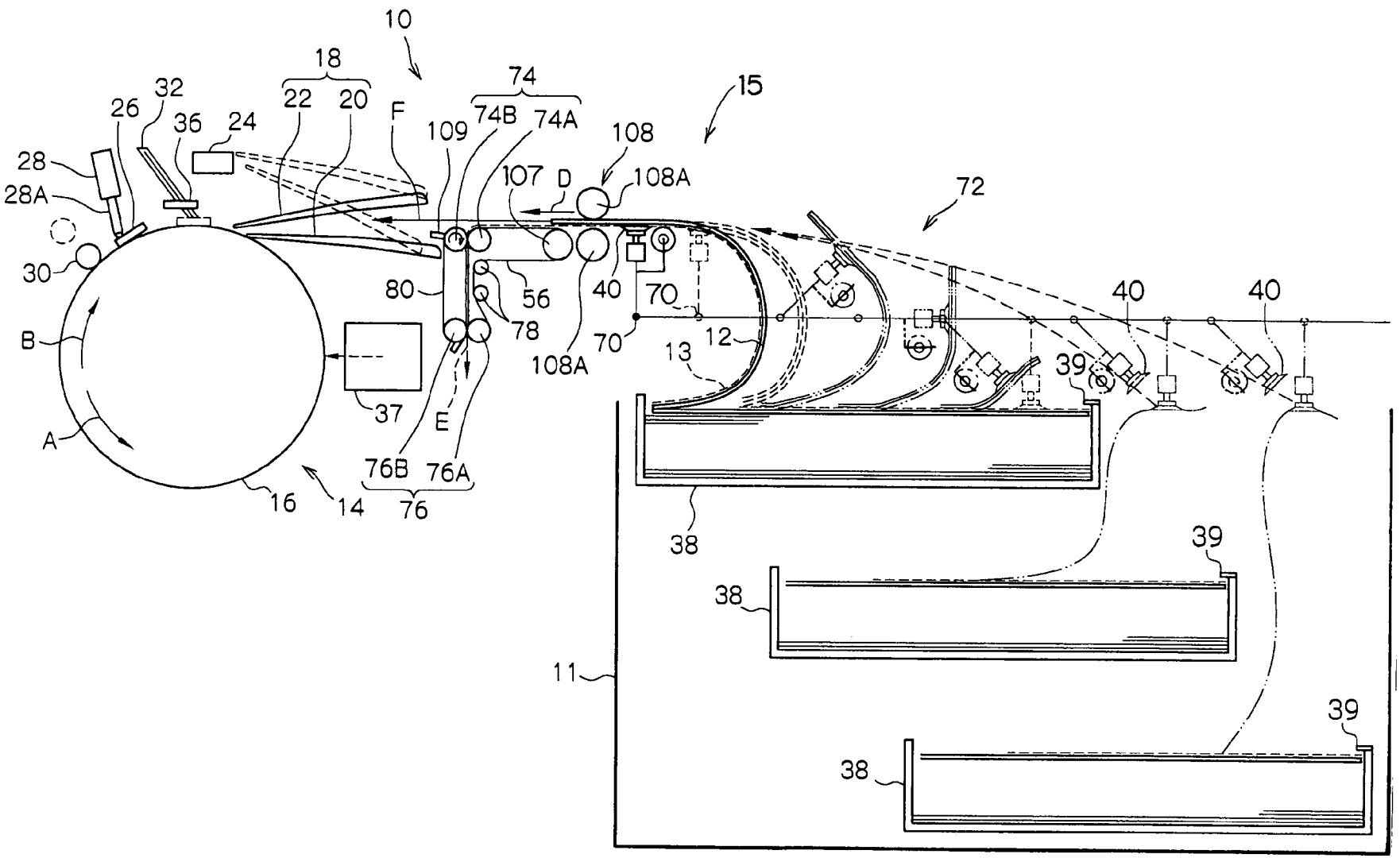
FIG. 1 is a schematic overall view of a printing plate automatic exposure device of a first embodiment of the present invention.

FIG. 1 shows general overall structure of a printing plate automatic exposure device 10 relating to a first embodiment of the present invention.

The printing plate automatic exposure device 10 can be divided into two blocks: an exposure section 14 which exposes an image by irradiating a light beam at an image-forming layer of a printing plate 12; and a sheet-feeding and transport section 15 which sheet-feeds the printing plate 12 and transports the same to the exposure section 14. The printing plate 12 that has been image processed is fed out by the printing plate automatic exposure device 10 to an unillustrated developing apparatus which is provided adjacent to the printing plate automatic exposure device 10.

Structure of the Exposure Section 14

The exposure section 14 is principally structured by a rotating drum 16, at a circumferential surface of which the printing plate 12 is wound on and retained. The printing plate 12 is guided by a conveyance guide unit 18 and fed in from a direction tangential to the rotating drum 16. The conveyance guide unit 18 is structured by a plate supply guide 20 and a plate ejection guide 22. At this conveyance guide unit 18, transport rollers 108 and a guide plate 109 are disposed at a side that borders with the sheet-feeding and transport section 15.

A positional relationship of the plate supply guide 20 and the plate ejection guide 22 of the conveyance guide unit 18 relative to one another is set to a horizontal V shape, and the plate supply guide 20 and plate ejection guide 22 form a structure which rotates through a predetermined angle about a center of rotation toward the right end side of FIG. 1. Consequent to this rotation, the plate supply guide 20 can be selectively disposed at a position corresponding with the rotating drum 16 (a position which is disposed along the tangential direction of the rotating drum 16) or a position corresponding with a direction of insertion into a puncher 24, which is disposed upward of the rotating drum 16. The printing plate 12 that has been fed from the sheet-feeding and transport section 15, is firstly guided by the plate supply guide 20 and fed in to the puncher 24, and a cut-out for positioning is formed at a leading end of this printing plate 12. After processing by the puncher 24, the printing plate 12 is, as necessary, temporarily returned to the plate supply guide 20, and then moved to a position corresponding with the rotating drum 16.

The rotating drum 16 is rotated in a direction for loading and exposing the printing plate 12 (the direction of arrow A in FIG. 1) and in a direction of removing the printing plate 12 (the direction of arrow B in FIG. 1), which is a direction opposite to the loading/exposing direction, by an unillustrated drive section.

A leading end chuck 26 is attached to the rotating drum 16 at a predetermined position of the outer peripheral surface thereof. When the printing plate 12 is to be loaded at the rotating drum 16, first, the rotating drum 16 is stopped with the leading end chuck 26 at a position facing a leading end of the printing plate 12 which is being fed in by the plate supply guide 20 of the conveyance guide unit 18 (a printing plate loading position).

At the exposure section 14, a mounting unit 28 is provided facing the leading end chuck 26 at the printing plate loading position. When one end side of the leading end chuck 26 is pushed by extension of an extending/contracting rod 28A of the mounting unit 28, insertion of the printing plate 12 between the leading end chuck 26 and the peripheral surface of the rotating drum 16 becomes possible. In a state in which the leading end of the printing plate 12 has been inserted between the leading end chuck 26 and the rotating drum 16, the extending/contracting rod 28A of the mounting unit 28 is withdrawn and pressure on the leading end chuck 26 is released. Consequently, the printing plate 12 is sandwiched between the leading end chuck 26 and the peripheral surface of the rotating drum 16, and retained. At this time, the leading end of the printing plate 12 is abutted against positioning pins (not shown), which are provided at the rotating drum 16. Thus, the printing plate 12 is positioned. Then, when the leading end of the printing plate 12 has been fixed at the rotating drum 16, the rotating drum 16 rotates in the loading/exposing direction. Consequently, in this structure, the printing plate 12 being fed in from the plate supply guide 20 of the conveyance guide unit 18 is wound on the peripheral surface of the rotating drum 16.

A squeeze roller 30 is disposed in a vicinity of the peripheral surface of the rotating drum 16, at a downstream side in the loading/exposing direction (the direction of arrow A in FIG. 1) from the printing plate loading position. By moving toward the rotating drum 16, the squeeze roller 30 pushes the printing plate 12 being wound on the rotating drum 16 toward the rotating drum 16, and can make the printing plate 12 closely correspond with the peripheral surface of the rotating drum 16.

Further, in the exposure section 14, a trailing end chuck attaching/removing unit 32 is disposed in a vicinity upstream from the leading end chuck 26 relative to the loading/exposing direction of the rotating drum 16. At the trailing end chuck attaching/removing unit 32, a trailing end chuck 36 moves along a guide which protrudes towards the rotating drum 16. When a trailing end of the printing plate 12 being wound onto the rotating drum 16 opposes the trailing end chuck attaching/removing unit 32, the trailing end chuck 36 moves toward the rotating drum 16 and the trailing end chuck 36 is mounted at a predetermined position of the rotating drum 16. Consequently, the trailing end chuck 36 sandwiches and retains the trailing end of the printing plate 12 between the trailing end chuck 36 and the rotating drum 16.

When the leading end and trailing end of the printing plate 12 are retained at the rotating drum 16, the squeeze roller 30 is moved away therefrom (refer to the broken line in FIG. 1).

Thereafter, the rotating drum 16 is rapidly rotated at a predetermined rotation speed and, synchronously with this rotation of the rotating drum 16, a light beam modulated on the basis of image data is irradiated from a recording head section 37. Accordingly, the printing plate 12 is scanned and exposed in accordance with the image data.

When scanning and exposure of the printing plate 12 has finished, the rotating drum 16 is temporarily stopped at a position at which the trailing end chuck 36 retaining the trailing end of the printing plate 12 faces the trailing end chuck attaching/removing unit 32, and the trailing end chuck 36 is removed from the rotating drum 16. Consequently, the trailing end of the printing plate 12 is released. Then the rotating drum 16 is rotated in the direction for removal of the printing plate 12. Thus, the printing plate 12 is discharged, from a trailing end side thereof, along a tangential direction of the rotating drum 16 to the plate ejection guide 22 of the conveyance guide unit 18. Thereafter, the printing plate 12 is ejected to a developing device for subsequent processing.

Structure of the Sheet-Feeding and Transport Section 15

Figure 2:
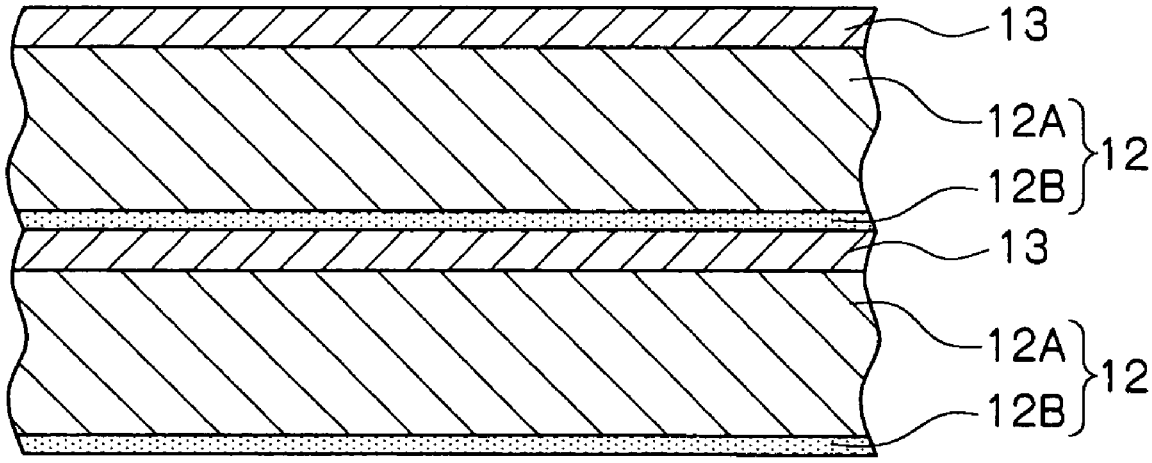
FIG. 2 is a sectional side view of principal elements, showing a state in which interleaf sheets and printing plates are stacked in a cassette.

As shown in FIG. 1, a cassette stock section 11 with a predetermined volume is provided at the sheet-feeding and transport section 15, and cassettes 38, which are set parallel with respect to a surface on which the printing plate automatic exposure device 10 is disposed, are provided. The cassettes 38 are stacked in a plurality of levels. Pluralities of the printing plates 12 are accommodated in the cassettes 38. As shown in FIG. 2, the printing plates 12 are a structure in which an emulsion surface 12B (an image recording surface) is formed on a support 12A. In the cassettes 38, interleaf sheets 13, which serve as protective sheets for protecting the emulsion surfaces 12B of the printing plates 12, and the printing plates 12, whose emulsion surfaces 12B are set face downward, are stacked alternately and accommodated.

Here, the cassettes 38 of the present embodiment are stacked in a state of being mutually offset in a horizontal direction. Offset amounts thereof are set in accordance with movement paths when the printing plates 12 (and the interleaf sheets 13 serving as the protective sheets) are brought out from the cassettes 38 by a sucker 40, which is described later.

At the sheet-feeding and transport section 15, a plurality of the sucker 40 are disposed with a spacing of a predetermined pitch at a base plate (not shown), which is provided along a lateral direction of the printing plates 12. The suckers 40 are categorized into a plurality of types. Accordingly, by providing a suction-adherence function that selects the types on the basis of sizes of the printing plates 12, the printing plates 12 can be suction-adhered with good balance.

A movement mechanism 72 is provided upward of the cassettes 38. The movement mechanism 72 suspendingly supports the suckers 40, and is capable of moving a base point 70 of this suspending support substantially horizontally in the left-right direction, in FIG. 1, of the cassettes 38.

The movement mechanism 72 is structured by the plate that supports the plurality of suckers 40 along the lateral direction of the cassettes 38 and a pair of rails between which the plate extends (none of which are shown).

The base point 70 that supports the suckers 40 is made to be rotatable. Herein, when the printing plates 12 are to be brought out from the cassettes 38, the plate to which the suckers 40 are attached is disposed on the rails at a right end portion, in FIG. 1, of the cassettes 38.

Because the interleaf sheets 13 and the printing plates 12, whose emulsion surfaces 12B are set face downward, are stacked alternately in the cassette 38, the sucker (or suckers) 40 makes contact with the interleaf sheet 13 at a top layer side in the cassette 38. A suction force is provided to the sucker 40 at a point in time when the sucker 40 has made contact. Thus, suction force is applied to the interleaf sheet 13 of the top layer, and naturally, to the printing plate 12 of the layer thereunder. The interleaf sheet 13 and the printing plate 12 are suction-adhered as a pair (a single set), and lifted up. Although ascent and descent of the sucker 40 is not shown in FIG. 1, the sucker 40 descends to the height level of the corresponding cassette, and the suction-adhered interleaf sheet 13 and printing plate 12 are separated (detached) from the other interleaf sheets 13 and printing plates 12 in lower layers by a separation plate 39, which is provided at each cassette 38. In this state, the sucker 40 ascends to an upper end level.

Here, movement paths in the vertical direction for bringing out the printing plates 12 from the cassettes 38 at the respective levels differ in accordance with lengths of the printing plates 12 (lengths thereof in the left-right direction of FIG. 1). Specifically, in a case of three levels, as in the present embodiment, only the leading edge portion of the printing plate 12 is lifted up when the printing plate 12 is brought out from the cassette 38 at the top level, about half to two-thirds of the printing plate 12 is lifted up when being brought out from the cassette 38 at the middle level, and the whole of the printing plate 12 is suspended when being brought out from the cassette 38 at the bottom level.

In this lifted out state, the plate that supports the suckers 40 starts to rotate about the base point 70 in an anti-clockwise direction, in FIG. 1, and starts to move along the rails in a leftward direction, in FIG. 1, of the cassettes 38. As a result, a suction point of the sucker 40 moves while describing a "cycloid" curve. The offset amounts of the cassettes 38 are specified in accordance with the path of this movement. Thus, whichever of the cassettes 38 the interleaf sheet 13 and the printing plate 12 are brought out from, it is possible to lift out the interleaf sheet 13 and printing plate 12 without interference with the cassette 38 at the top level side.

Now, it is most preferable if the printing plate 12 does not interfere at all with the top layer side cassette 38. However, because the face that abuts against this cassette 38 is the interleaf sheet 13 (a rear face side of the printing plate 12), if there is a prerequisite that space for the cassette stock section 11 be kept small in plan view, a certain amount of contact during movement of the sucker 40 in the direction of left-right movement (the horizontal direction) is acceptable, as long as contact is avoided during the movement of the sucker 40 in the direction of ascent and descent (the vertical direction) and during the rotation movement.

When the sucker 40 has rotated through 180°, in the state in FIG. 1, the interleaf sheet 13 is at the underside and the printing plate 12 is at the overside. Thus, the printing plate 12 and interleaf sheet 13 are handed over to the transport rollers 108.

A belt 56 is wound round a roller 107, which is adjacent to a lower side roller 108A of the transport rollers 108. This belt 56 is also wound round a right side roller 74A of a pair of rollers 74, which is disposed near the conveyance guide unit 18 of the exposure section 14. Downward of the pair of rollers 74, a further pair of rollers 76 is provided. The belt 56 is wound round a right side roller 76A of these lower rollers 76 and both of a pair of small rollers 78. The belt 56 forms a substantially L-shaped loop overall, and is driven in the direction of arrow D in FIG. 1.

A belt 80 extends between a left side roller 74B of the upper pair of rollers 74 and a left side roller 76B of the lower pair of rollers 76.

The roller 74B rotates in a direction opposite to a transport direction, and forms a structure at which a frictional force on the interleaf sheet 13 is large. During usual transport, the left side roller 74B is withdrawn to a lower side relative to a plane of transport. When the printing plate 12 and interleaf sheet 13 have passed over the left side roller 74B, the left side roller 74B ascends, and draws the interleaf sheet 13 in between the rollers 74 by the frictional force. Then, the left side roller 74B withdraws again. The interleaf sheet 13 is fed between the lower pair of rollers 76, and is discarded (see the broken line arrow E in FIG. 1).

Meanwhile, the printing plate 12 passes above the upper pair of rollers 74, and is fed in to the plate supply guide 20 (see the solid arrow F in FIG. 1).

Structure of the Sucker 40

Figure 3:
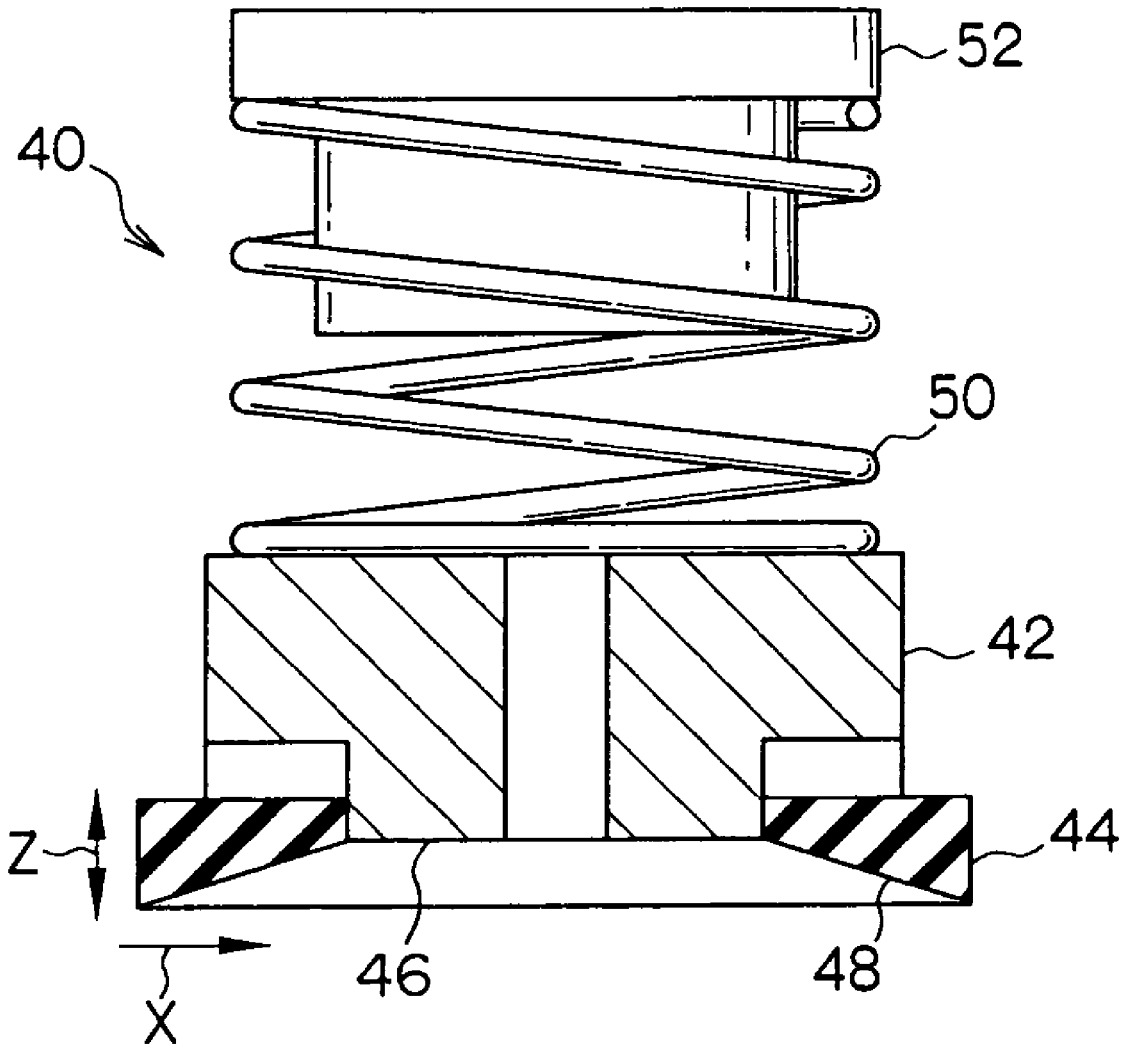
FIG. 3 is a sectional side view of principal elements, showing structure of a usual state of a sucker relating to the first embodiment.

FIG. 3 shows a structure of the sucker 40 relating to the first embodiment, in a sectional view.

This sucker 40 is structured by a main body portion 42, a skirt portion 44 and a spring 50, which serves as a moment-absorbing structure.

The main body portion 42 is structured by a stiff body (for example, a metal material, a hard resin material or the like). The main body portion 42 includes a suction-adherence surface 46 for generating suction force on the interleaf sheet 13 during suction-adherence of the interleaf sheet 13 and the printing plate 12 as described above. This suction-adherence surface 46 is formed as a surface including minute protrusions and indentations (for example, of the order of 5 μm to 500 μm). In such a case, the suction-adherence surface 46 can be realized by, for example, a blasting treatment, a predetermined coating treatment or the like. Forming this surface is not limited to these surface treatments. For example, it is possible to form this surface by using a sponge or brush with high stiffness or the like.

Further, the suction-adherence surface 46 is specified such that a gap between the suction-adherence surface 46 and the interleaf sheet 13 during the suction-adherence is 0.5 mm or less.

The skirt portion 44 is formed by a resilient body (for example, a rubber material or the like). The skirt portion 44 is provided at surroundings of the suction-adherence surface 46 of the main body portion 42. This skirt portion 44 resiliently deforms and closely corresponds with the interleaf sheet 13 during the suction-adherence, and is a structure which is capable of preserving airtightness.

Here, if: a resilient force of the skirt portion 44 in a direction intersecting the suction-adherence surface 46 of the main body portion 42 (direction Z in FIG. 3) is $E_1$, a resilient force of the skirt portion 44 in a direction parallel to the suction-adherence surface 46 of the main body portion 42 (direction X in FIG. 3) is $E_2$, a total component in the direction intersecting the suction-adherence surface 46 of internal pressure of the main body portion 42 during the suction-adherence is $P_1$, and a total component in the direction parallel to the suction-adherence surface 46 of the internal pressure of the main body portion 42 during the suction-adherence is $P_2$, then the structure is specified such that the following relationships stand:

$$E_1<P_1 \text{ and } E_2>P_2.$$

Forms and the like of the main body portion 42 and the skirt portion 44 are specified such that an interleaf sheet close-contact surface 48 of the skirt portion 44 is parallel to the suction-adherence surface 46 of the main body portion 42 during the suction-adherence.

The spring 50 is joined with the main body portion 42, and is attached to a base portion 52. Thus, the spring 50 supports the main body portion 42. When the printing plate 12 is sucked and sheet-fed by the sucker 40, the main body portion 42 is displaced in a direction of a moment that acts from the printing plate 12, by resilient deformation of the spring 50. Thus, this structure is capable of substantially absorbing the moment.

Incidentally, a gap t between the suction-adherence surface and the protective sheet during the suction-adherence operation can be set in accordance with a resilient force in the skirt portion, a coefficient of friction between the skirt portion and the protective sheet, and stiffness of the protective sheet, and the gap t is set to a range such that the protective sheet will substantially not be drawn in toward the suction-adherence surface at a moment in time of suction-adherence of the protective sheet. Further, the skirt portion can comprise at least one of a sponge and a brush.

Next, operation of the first embodiment will be described.

In the printing plate automatic exposure device 10 with the structure described above, when the printing plates 12 (and the interleaf sheets 13) are to be taken out from the cassettes 38, one of the cassettes 38 stacked at the plurality of levels is designated. When this cassette 38 is designated, the sucker 40 is positioned at a vicinity of a right end direction, in FIG. 1, of the designated cassette 38. After this positioning, the sucker 40 descends to the height level of the cassette 38. At this time, although the height levels of the respective cassettes 38 are different, movements of the sucker 40 are respectively simple linear vertical movements.

When the sucker 40 descends, the sucker 40 makes contact with the interleaf sheet 13 positioned at the topmost layer of the designated cassette 38. In this state, suction by the sucker 40 commences, and the sucker 40 begins to ascend. During this ascent, the sucker 40 sucks both of the interleaf sheet 13 of the topmost layer and the printing plate 12 thereunder. In this sense, the sucker 40 can be referred to as a double suction-type sucker.

Here, when the printing plate 12 and interleaf sheet 13 are removed from the cassette 38, there is a possibility that the printing plate 12 that is suction-adhered is closely adhered to the interleaf sheet 13 and printing plate 12 of a subsequent layer, by static electricity at the suction-adhered printing plate 12 and vacuum adherence of the plate itself. In such a case, the printing plate 12 is separated by the separation plate 39 that is provided at the cassette 38. Thus, only the interleaf sheet 13 of the topmost layer, which is subjected to the suction force, and the printing plate 12 therebelow are brought out from the cassette 38.

When the sucker 40 brings out the printing plate 12 (and the interleaf sheet 13) and reaches an uppermost point, the sucker 40 rotates through 180° around the base point 70 while moving horizontally toward the exposure section 14. At this time, a pick-up position of the printing plate 12 (the point of suction by the sucker 40) moves to describe the "cycloid" curve. Therefore, if the printing plate 12 (and the interleaf sheet 13) has been brought out from the lower level side cassettes 38, the printing plate 12 is transported while being wound around the top layer side cassette 38 in accordance with a flexing strength of the printing plate 12. As a consequence, the printing plate 12 is very unlikely to make contact with the top layer side cassette 38. Note that if the printing plate 12 does contact the top layer side cassette 38, it is the rear face side of the printing plate 12 that makes contact. Therefore, slight contacts can be tolerated.

When the printing plate 12 (and the interleaf sheet 13) has rotated through 180°, the printing plate 12 is handed over to the transport rollers 108. Further, after the printing plate 12 and the interleaf sheet 13 have passed over the left side roller 74B, the left side roller 74B ascends, draws the interleaf sheet 13 between the rollers 74 by means of frictional force, and the interleaf sheet 13 is peeled away from the printing plate 12. The interleaf sheet 13 that has been peeled away is fed to the lower pair of rollers 76 in accordance with the driving of the belt 56, and is discarded to an unillustrated discard box.

Meanwhile, the printing plate 12 continues to be transported substantially horizontally past the guide plate 109 and is fed in to the plate supply guide 20. The printing plate 12 on the plate supply guide 20 is fed to the rotating drum 16, and the leading edge portion of the printing plate 12 is retained by the leading end chuck 26. In this state, the printing plate 12 is tightly wound onto the peripheral surface of the rotating drum 16 when the rotating drum 16 rotates, and then the trailing end of the printing plate 12 is retained by the trailing end chuck 36. Thus, preparation for exposure is completed.

In this state, image data is read in, and exposure processing by the light beam from the recording head section 37 is commenced. This exposure processing is "scanning exposure", in which the rotating drum 16 is rotated at high speed (main scanning) and the recording head section 37 moves in the axial direction of the rotating drum 16.

When the exposure processing has finished, the conveyance guide unit 18 is switched (the plate ejection guide 22 is made to correspond with the rotating drum 16), and then the printing plate 12 wound on the rotating drum 16 is ejected in the tangential direction. At this time, the printing plate 12 is fed to the plate ejection guide 22. When the printing plate 12 has been fed to the plate ejection guide 22, the conveyance guide unit 18 is switched, the plate ejection guide 22 is made to correspond with an ejection port, and the printing plate 12 is ejected. A developing section is provided in the direction of this ejection, and the printing plate 12 continues on to be processed for development.

Now, when the interleaf sheet 13 and the printing plate 12 in the cassette 38 are suction-adhered and sheet-fed by the sucker 40 as described above, the printing plate 12 and the interleaf sheet 13 are simultaneously sucked from the interleaf sheet 13 side thereof and sheet-fed. During this suction by the sucker 40, the suction-adherence surface 46 of the main body portion 42 faces the interleaf sheet 13 and generates the suction force. The skirt portion 44 resiliently deforms to follow along with the interleaf sheet 13, closely corresponds with the interleaf sheet 13, and assures airtightness.

Figure 4:
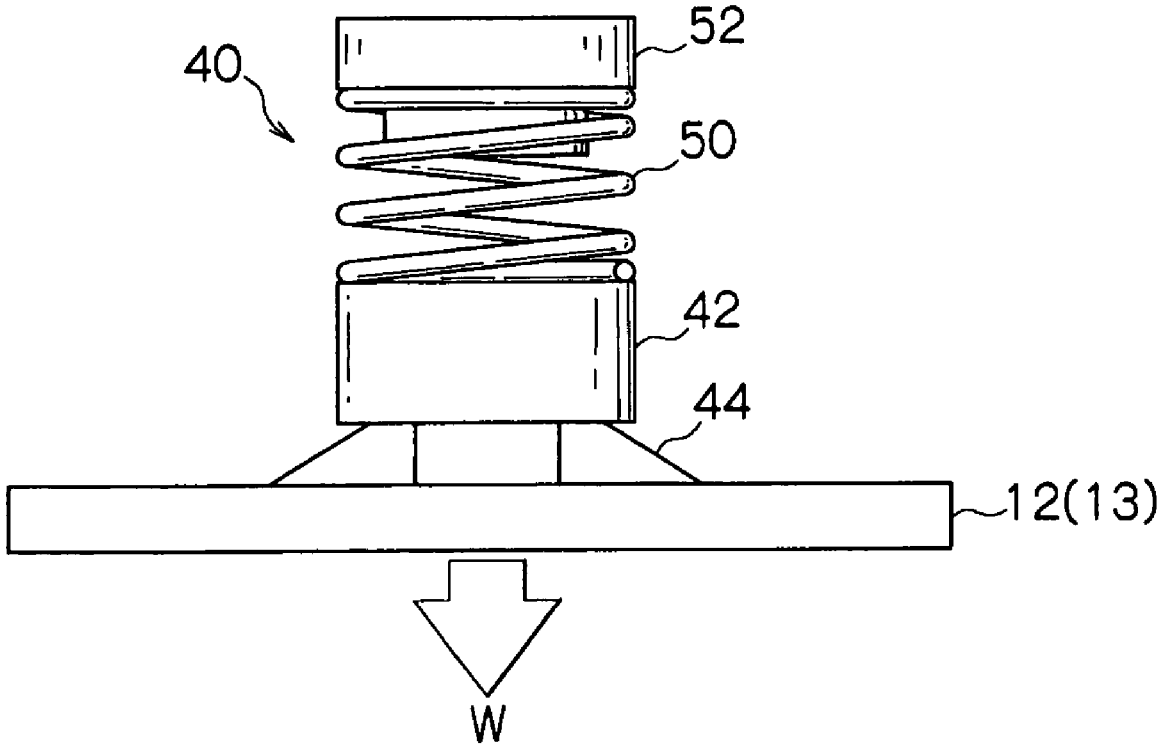
FIG. 4 is a side view of the sucker during a suction operation, in a state in which a moment is not acting.

At this time, as shown in FIG. 4, if a moment from the printing plate 12 does not act on the sucker 40 during sheet-feeding, the main body portion 42 does not deform (incline) in any direction. Further, when a load is applied during the suction, because the main body portion 42 is formed by a stiff body, the main body portion 42 will not be deformed by the load during the suction-adherence. Accordingly, the interleaf sheet 13 is not hoistingly deformed, and wrinkling does not occur at the interleaf sheet 13. Therefore, air leaks will not be formed between the interleaf sheet 13 and the printing plate 12, and the interleaf sheet 13 and the printing plate 12 can both be stably suction-adhered and sheet-fed simultaneously.

Figure 5:
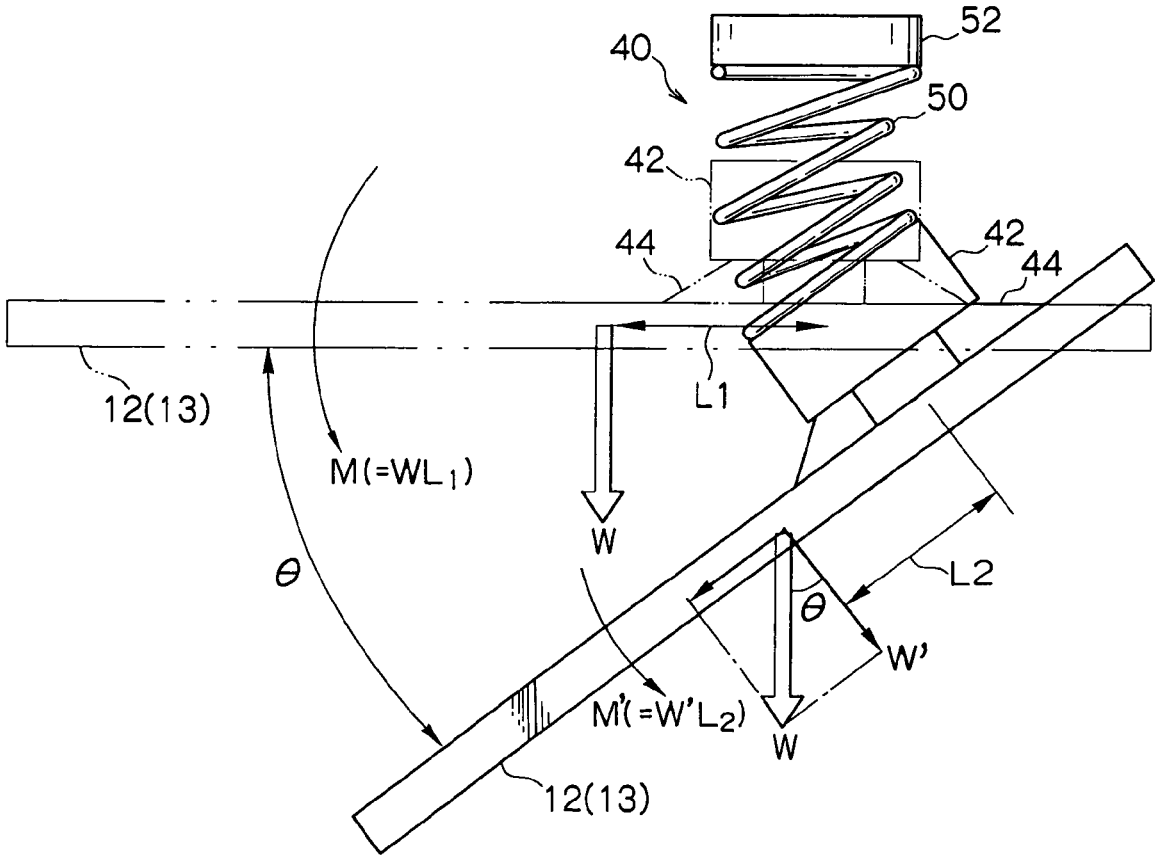
FIG. 5 is a side view of the sucker during the suction operation, in a state in which a moment is acting.

However, when a moment M ($=W\times L_1$) acts on the sucker 40 due to a load W from the printing plate 12 during sheet-feeding, as shown in FIG. 5, because the spring 50, which serves as the moment-absorbing structure, is joined to the main body portion 42 of the sucker 40, the spring 50 resiliently deforms. Thus, the main body portion 42 is displaced (inclined) in the direction in which the moment acts, and an effective load on the sucker 40 (the main body portion 42) is reduced ($W>W'$). As a result, a moment M' ($=W'\times L_2$) with respect to the position of suction by the sucker 40 attains a reduced state (i.e., the moment M is substantially absorbed). Here, all directions relative to the sucker 40 are directions of absorption of moments M.

Accordingly, an excessive moment M does not act on the sucker 40 even when the load is applied to the sucker 40 during suction-adherence and sheet-feeding. Moreover, because the spring 50 (the resilient body) which redirects the moment M is structurally separate from the main body portion 42 and skirt portion 44 of the sucker 40, the sucker 40 (i.e., the main body portion 42 and the skirt portion 44) does not deform. Therefore, the interleaf sheet 13 is not hoistingly deformed, and wrinkling does not arise at the interleaf sheet 13. Consequently, air leaks between the interleaf sheet 13 and the printing plate 12 will not be formed, and the printing plate 12 and interleaf sheet 13 can be stably suction-adhered and sheet-fed together at the same time.

Now, a second embodiment of the present invention will be described.

Note that components that are substantially the same as in the first embodiment are assigned the same reference numerals as in the first embodiment, and descriptions thereof are omitted.

Figure 6:
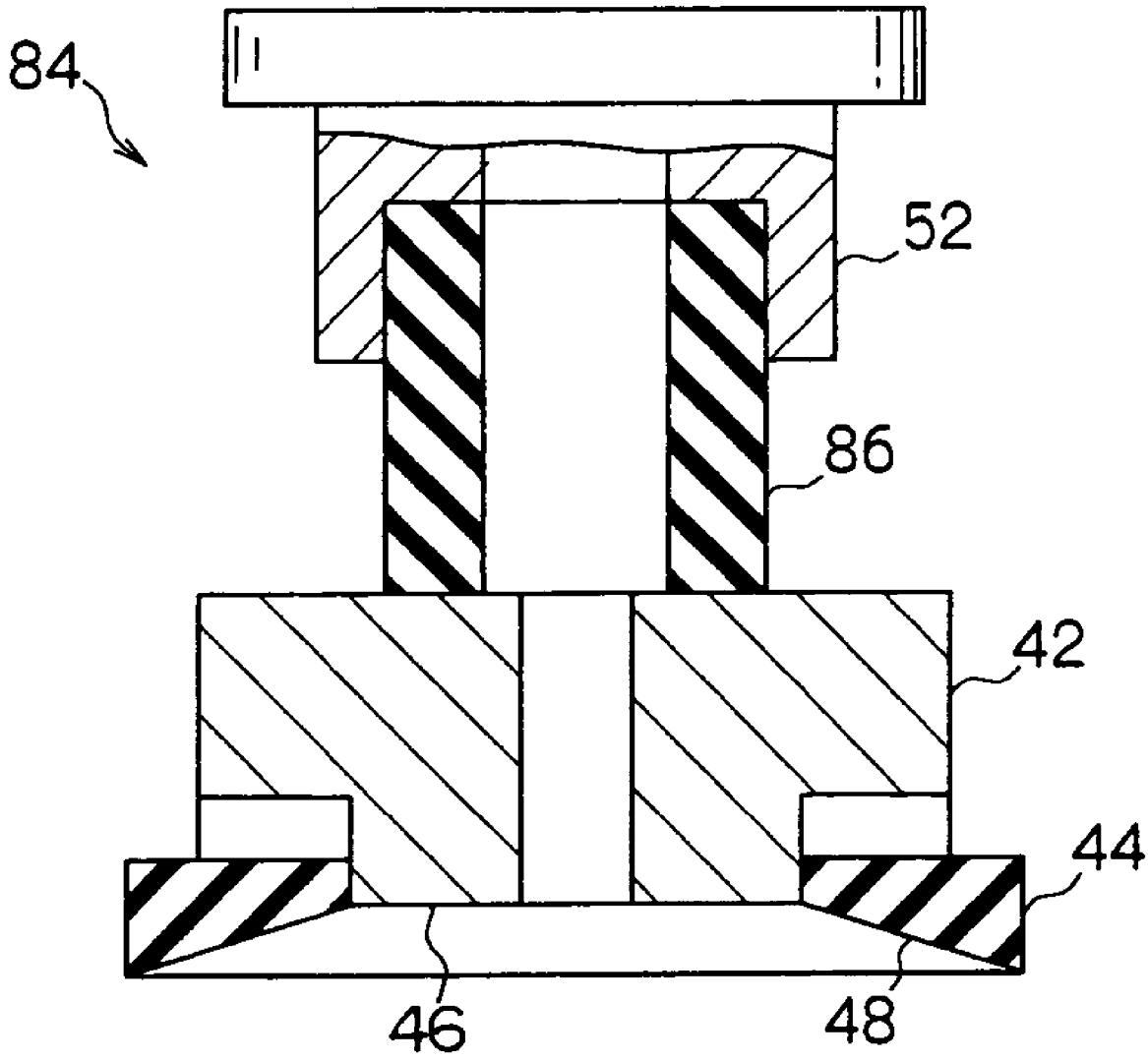
FIG. 6 is a sectional side view of principal elements, showing structure of a sucker relating to a second embodiment.

FIG. 6 shows structure of a sucker 84 relating to the second embodiment.

In this sucker 84, a tubular rubber body 86, which serves as the moment-absorbing structure, is joined to the main body portion 42. This rubber body 86, similarly to the spring 50 relating to the first embodiment described above, resiliently deforms when the sucker 84 suction-adheres and sheet-feeds the printing plate 12. Thus, the rubber body 86 displaces the main body portion 42 in a direction in which moment from the printing plate 12 acts, and has a function of being able to substantially absorb the moment.

At the sucker 84 relating to the second embodiment too, when a moment from the printing plate 12 acts during sheet-feeding, the rubber body 86 resiliently deforms, the main body portion 42 is displaced (inclined) in the direction of the moment, and an effective load on the sucker 84 (the main body portion 42) is reduced. Consequently, the moment with respect to the suction position of the sucker 84 attains a reduced state (i.e., the moment is substantially absorbed). Moments in all directions relative to the sucker 84 can be absorbed.

Accordingly, an excessive moment does not act on the sucker 84 even when a load is applied to the sucker 84 during suction-adherence and sheet-feeding. Moreover, because the rubber body 86 (the resilient body) which redirects the moment is structurally separate from the main body portion 42 and skirt portion 44 of the sucker 84, the sucker 84 (i.e., the main body portion 42 and the skirt portion 44) does not deform. Therefore, the interleaf sheet 13 is not hoistingly deformed, and wrinkling does not arise at the interleaf sheet 13. Consequently, air leaks between the interleaf sheet 13 and the printing plate 12 will not be formed, and the printing plate 12 and interleaf sheet 13 can be stably suction-adhered and sheet-fed together at the same time.

Figure 7:
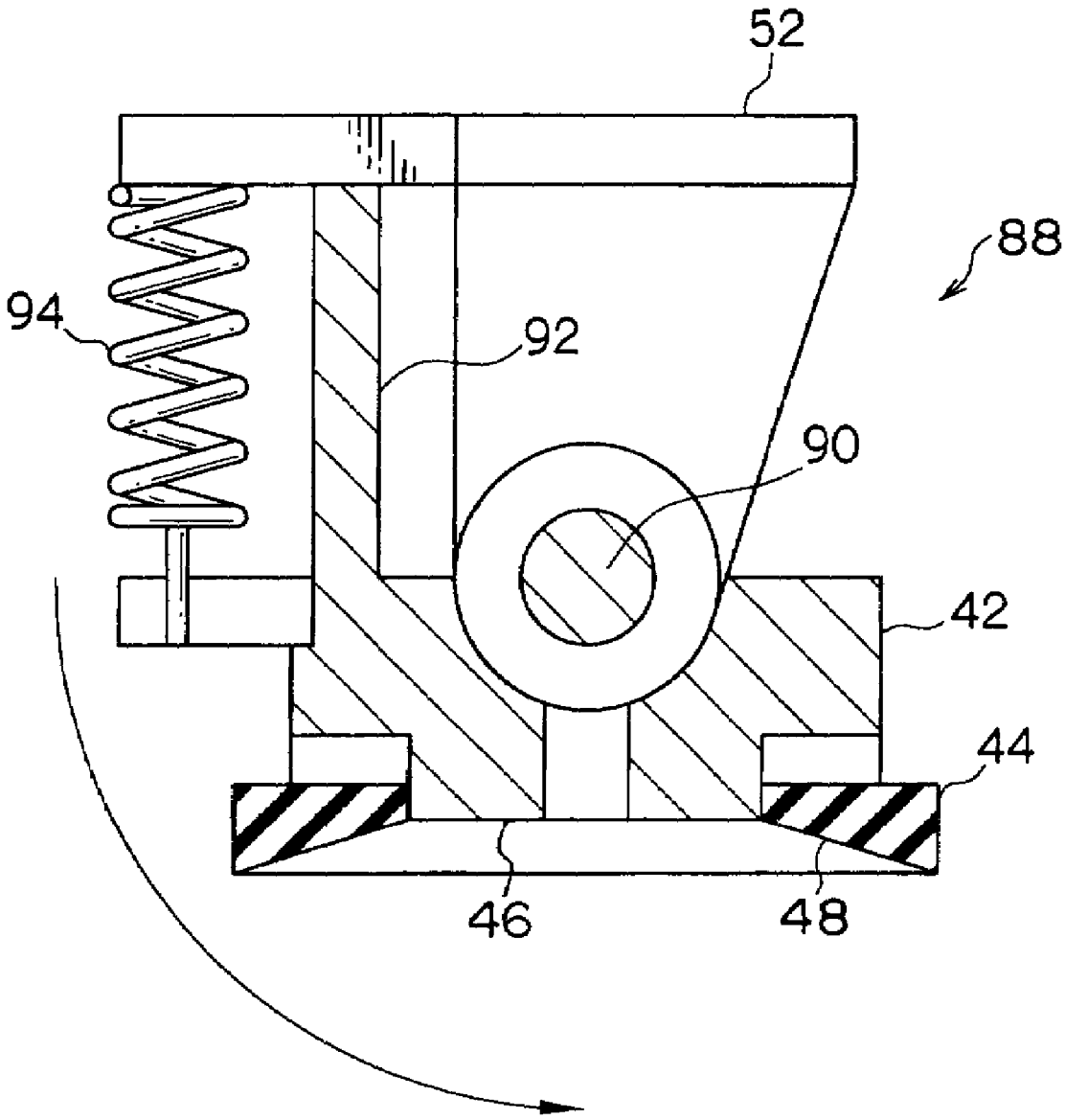
FIG. 7 is a sectional side view of principal elements, showing structure of a sucker relating to a third embodiment.
Figure 8A:
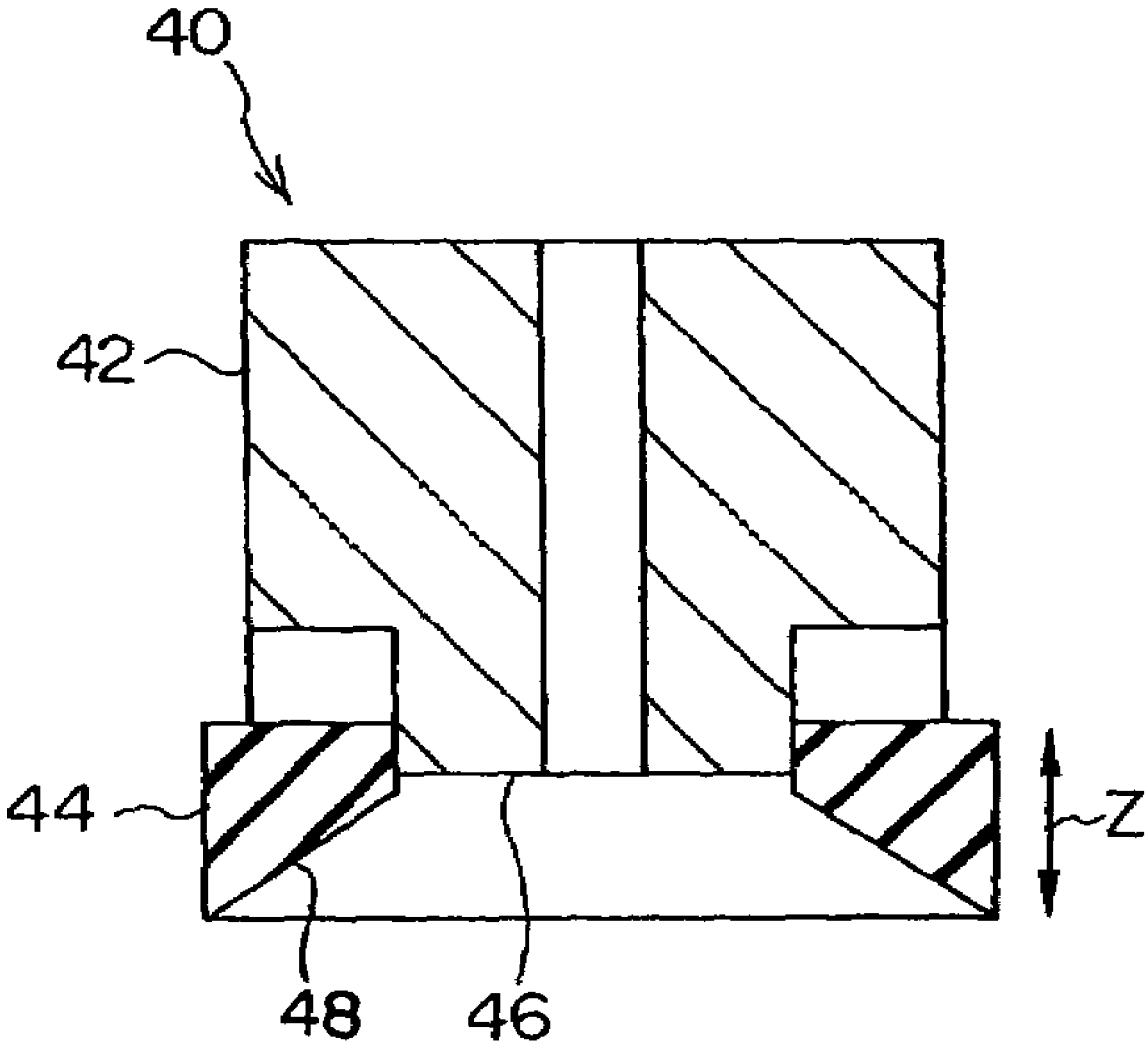
FIG. 8A is a sectional side view showing structure of a usual state of a sucker relating to a fourth embodiment.
Figure 8B:
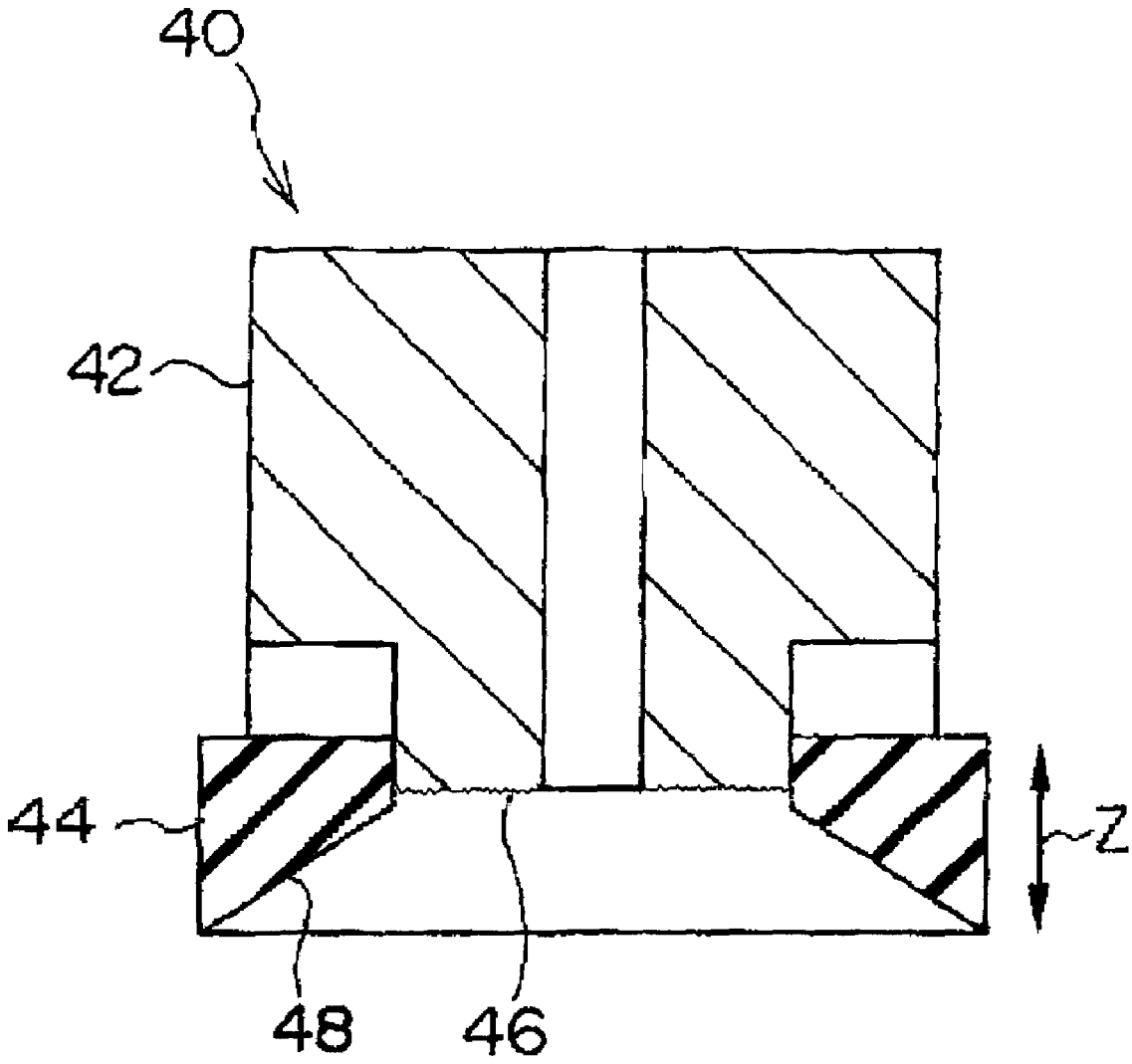
FIG. 8B is a sectional side view showing the structure of a sucker relating to the fourth embodiment in which the suction-adherence surface includes minute protrusions and indentations.
Figure 8C:
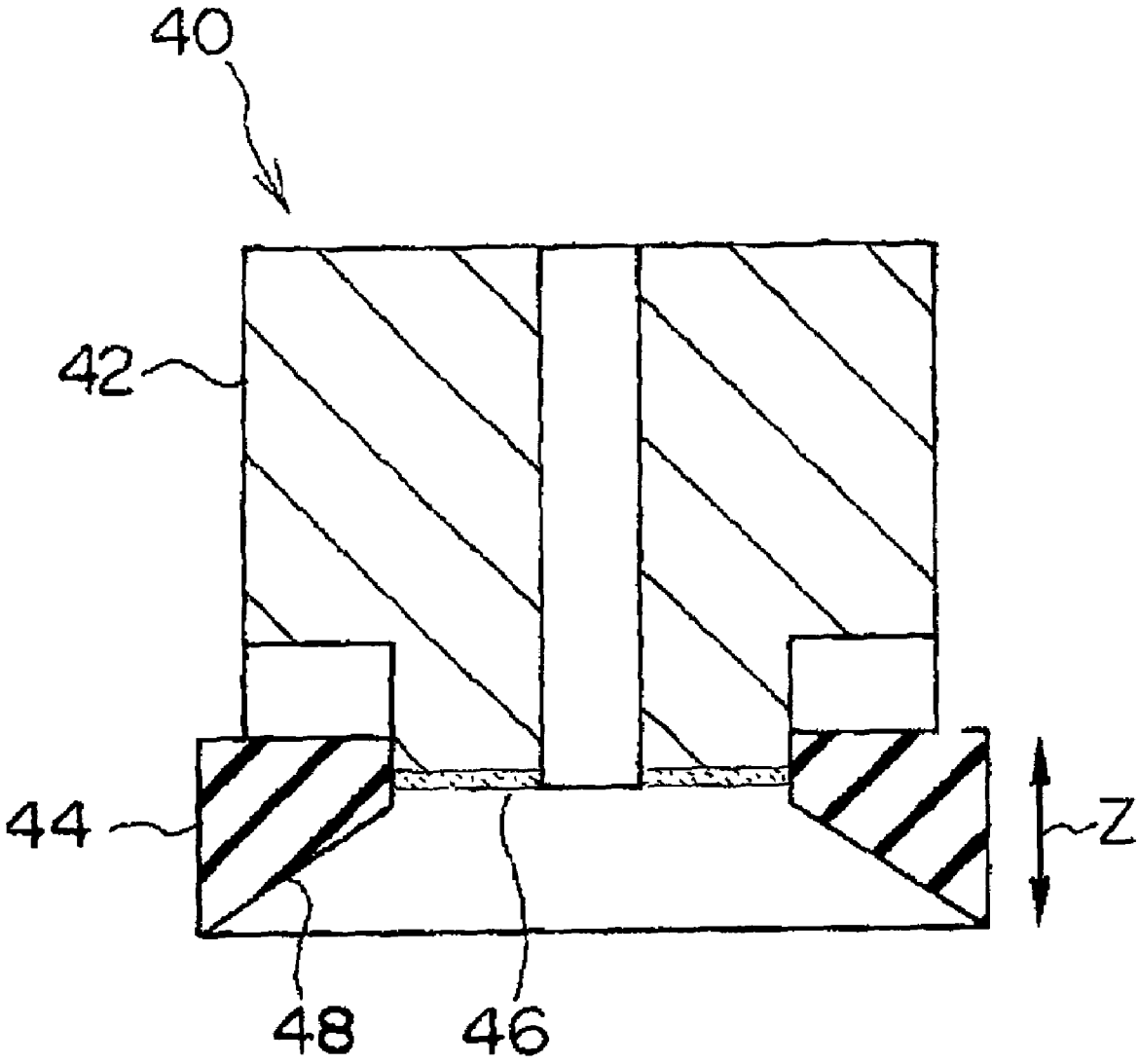
FIG. 8C is a sectional side view showing the structure of a sucker relating to the fourth embodiment in which the suction-adherence surface comprises a sponge.
Figure 8D:
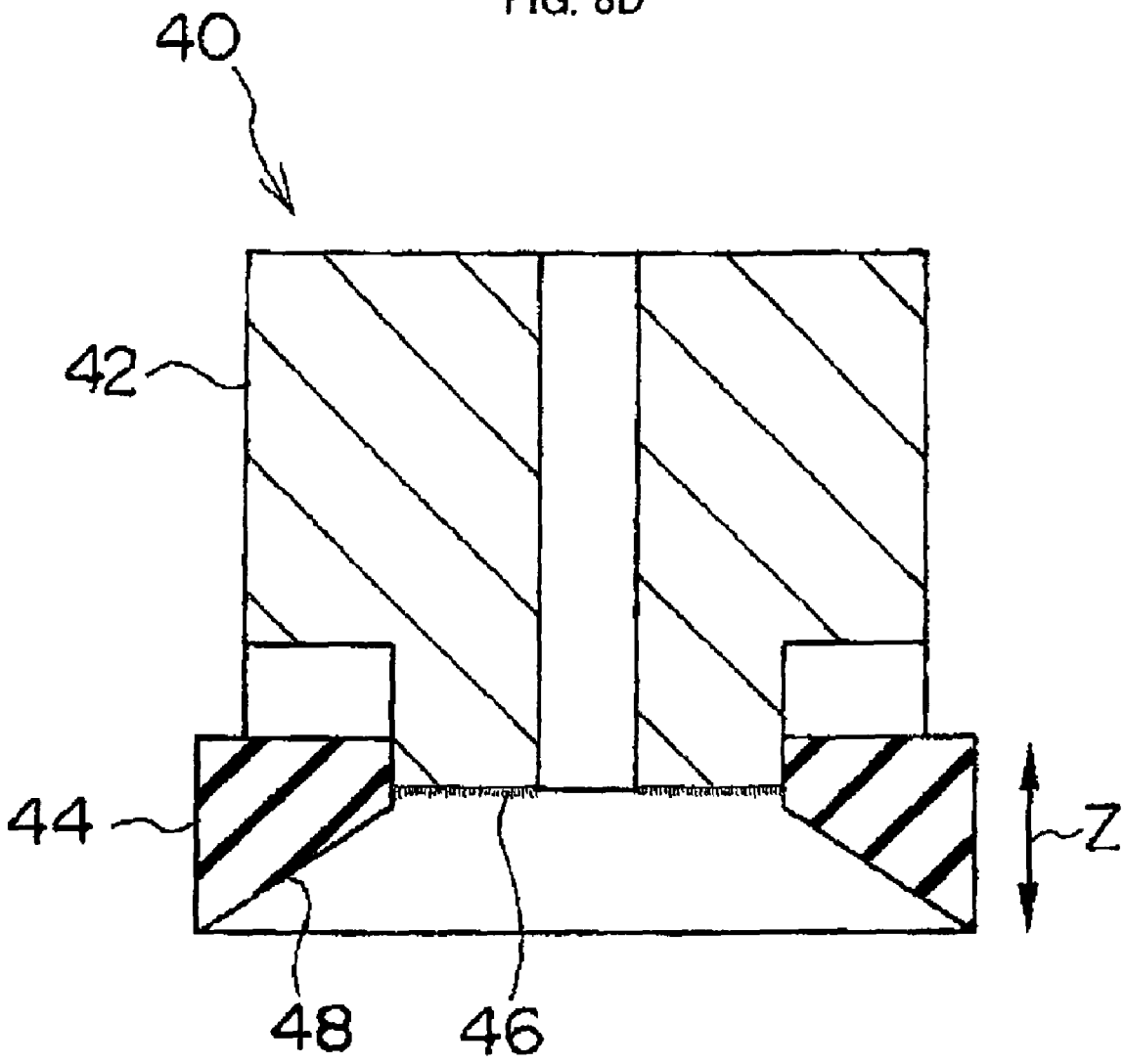
FIG. 8D is a sectional side view showing the structure of a sucker relating to the fourth embodiment in which the suction-adherence surface comprises a brush.
Figure 9:
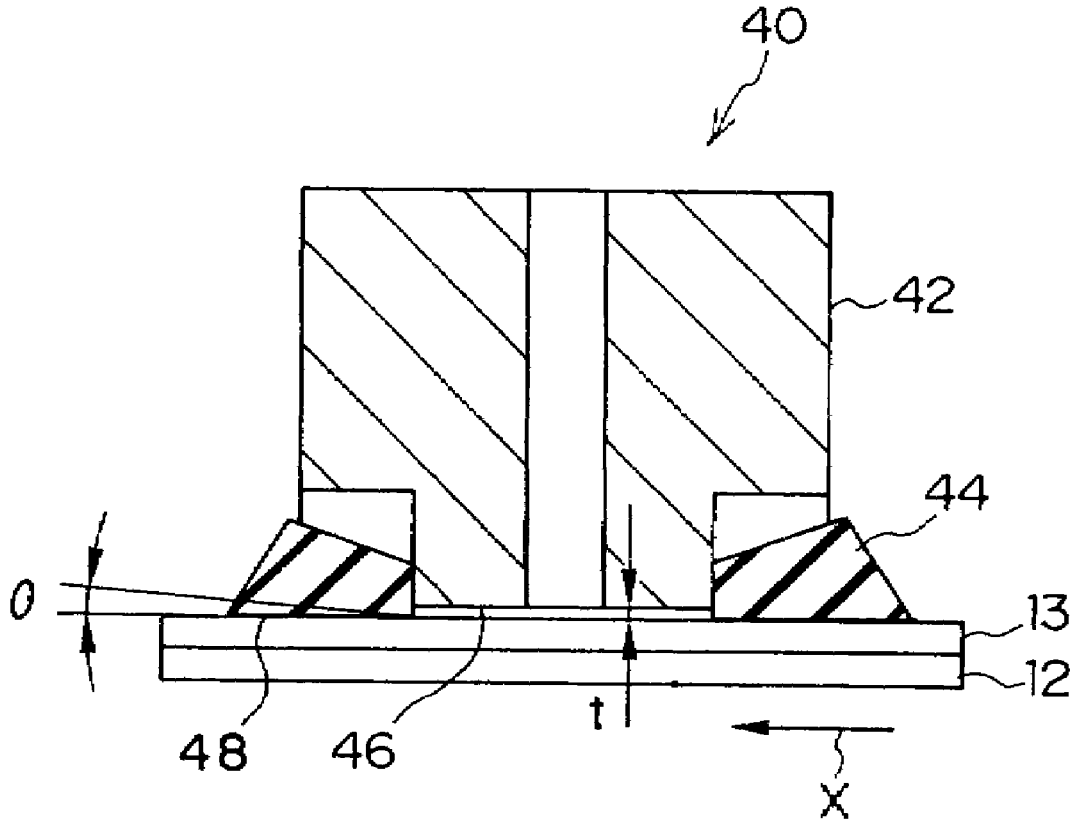
FIG. 9 is a sectional side view of a sucker during a suction operation.

Next, FIG. 7 shows structure of a sucker 88 relating to a third embodiment.

At this sucker 88, the main body portion 42 is rotatably supported at the base portion 52 by a support shaft 90, and a stopper 92 is provided at the main body portion 42. The stopper 92 limits rotation of the main body portion 42 around the support shaft 90 to a predetermined range.

Furthermore, a tension spring 94, which serves as the moment-absorbing structure, is joined to one end portion of the main body portion 42. Similarly to the spring 50 relating to the first embodiment and the rubber body 86 relating to the second embodiment described above, this tension spring 94 resiliently deforms when the sucker 88 suction-adheres and sheet-feeds the printing plate 12. Thus, the tension spring 94 displaces (inclines by rotation around the support shaft 90) the main body portion 42 in a direction in which moment from the printing plate 12 acts, and has the function of being able to substantially absorb the moment.

At the sucker 88 relating to the third embodiment too, when a moment acts on the printing plate 12 during sheet-feeding, the tension spring 94 resiliently deforms, the main body portion 42 is displaced (inclined by rotation around the support shaft 90) in the direction of the moment, and an effective load on the sucker 88 (the main body portion 42) is reduced. Consequently, the moment with respect to the suction position of the sucker 88 attains a reduced state (i.e., the moment is substantially absorbed). Note that, in this case, only a single direction relative to the sucker 88 (i.e., the direction of rotation around the support shaft 90) is a direction of absorption of moments.

Accordingly, an excessive moment does not act on the sucker 88 even when a load is applied to the sucker 88 during suction-adherence and sheet-feeding. Moreover, because the tension spring 94 (the resilient body) which redirects the moment is structurally separate from the main body portion 42 and skirt portion 44 of the sucker 88, the sucker 88 (i.e., the main body portion 42 and the skirt portion 44) does not deform. Therefore, the interleaf sheet 13 is not hoistingly deformed, and wrinkling does not arise at the interleaf sheet 13. Consequently, air leaks between the interleaf sheet 13 and the printing plate 12 will not be formed, and the printing plate 12 and interleaf sheet 13 can be stably suction-adhered and sheet-fed together at the same time.

Lastly, a fourth embodiment of the present invention will be described.

Referring to FIGS. 8A, 8B, 8C, 8D and 9, the sucker 40 of the present embodiment has substantially the same structure as in the first embodiment except that the main body portion 42 integrally includes a base portion, and there is no spring.

Details of the sucker of the fourth embodiment are as follows.

The main body portion 42: a stiff body

Diameter of the suction-adherence surface 46 of the main body portion 42: 35 mm Blasting treatment of the suction-adherence surface 46 of the main body portion 42 (condition of protrusions and indentations): 25 μm

| | |
|---|---|
| Gap t between the suction-adherence surface 46 of the main body portion 42 and the interleaf sheet 13 during suction | $0 \leqq t \leqq 0.5$ mm |
| Material of the skirt portion 44 | EPDM (EPT) |
| External diameter of the skirt portion 44 | 44 mm |
| Rubber hardness of the skirt portion 44 | 45° ± 5° |
| Resilient force $E_1$ of the skirt portion 44 | approx. 340 g |
| Pushing force W of the skirt portion 44 during suction | 500 g |
| Stroke of the skirt portion 44 during suction | approx. 2.5–3.0 mm |

Angle θ° between the interleaf sheet 13 close-contact surface 48 of the skirt portion 44 and the interleaf sheet 13 during suction: 0°

Form of the skirt portion 44 during suction: thickness of external periphery portion 3 mm: thickness of central portion 1 mm With this sucker 40, because the gap t between the suction-adherence surface 46 of the main body portion 42 and the interleaf sheet 13 during suction is set to the range $0 \leqq t \leqq 0.5$ mm, the interleaf sheet 13 will not be drawn in toward the suction-adherence surface 46 of the main body portion 42 (i.e., a suction force-generating portion) at a moment in time at which the interleaf sheet 13 (and the printing plate 12) is suction-adhered, and wrinkling will not occur at the interleaf sheet 13. Therefore, air leaks will not be formed between the interleaf sheet 13 and the printing plate 12, and the printing plate 12 and the interleaf sheet 13 can be stably suction-adhered and sheet-fed together at the same time.

Further, with this sucker 40, the skirt portion 44 deforms easily (i.e., has a deformation-following characteristic) in a direction intersecting the suction-adherence surface 46 of the main body portion 42 (a direction of thickness of the interleaf sheet 13 during suction; i.e., direction Z in FIGS. 8A, 8B, 8C and 8D). Meanwhile, the skirt portion 44 is resistant to deformation in a direction parallel to the suction-adherence surface 46 of the main body portion 42 (a direction along the surface of the interleaf sheet 13 during suction; i.e., direction X in FIG. 9).

Therefore, the skirt portion 44 follows the surface of the interleaf sheet 13 during suction, while resiliently deforming to closely correspond with the interleaf sheet 13. Thus, effects of deformation of the skirt portion 44 are not transmitted to the suction-adherence surface 46 (the suction force-generating portion) of the main body portion 42. Further, in the suction state (the state in which the skirt portion 44 closely corresponds with the interleaf sheet 13), the skirt portion 44 is not deformed by internal pressure at the suction-adherence surface 46 (the suction force-generating portion) of the main body portion 42. Therefore, the interleaf sheet 13 will not be drawn in toward the suction-adherence surface 46 (the suction force-generating portion) of the main body portion 42. Consequently, the occurrence of wrinkling at the interleaf sheet 13 is further prevented. Therefore, air leaks will not be formed between the interleaf sheet 13 and the printing plate 12, and the printing plate 12 and the interleaf sheet 13 can be stably suction-adhered and sheet-fed together at the same time.

With this sucker 40, because shapes and the like of the main body portion 42 and the skirt portion 44 are specified such that the interleaf sheet 13 close-contact surface 48 of the skirt portion 44 is parallel to the suction-adherence surface 46 of the main body portion 42, the skirt portion 44 will not be deformed by internal pressure at the suction-adherence surface 46 (the suction force-generating portion) of the main body portion 42 in the suction state (the state in which the skirt portion 44 closely corresponds with the interleaf sheet 13). Accordingly, the interleaf sheet 13 is prevented from being drawn in toward the suction-adherence surface 46 (the suction force-generating portion) of the main body portion 42 as a result, and the occurrence of wrinkling at the interleaf sheet 13 is prevented. Consequently, air leaks will not arise between the interleaf sheet 13 and the printing plate 12, and the printing plate 12 and the interleaf sheet 13 can be stably suction-adhered and sheet-fed together at the same time.

Further yet, because the suction-adherence surface 46 of the main body portion 42 is formed as a surface with minute protrusions and indentations, even if tension is applied to the interleaf sheet 13 at the suction-adherence surface 46 of the main body portion 42 during suction, a small gap necessary for generating suction force can be maintained. Moreover, air paths over the whole of the suction force-generating portion will not be blocked. Accordingly, a reduction in suction force can be prevented, and the suction force can be consistently applied for suction-adherence.

With a printing plate sucker relating to the present invention as described above, wrinkling at a protective sheet does not occur during suction-adherence, and reductions in suction force are prevented without unnecessary tension being applied to the protective sheet. Thus, the printing plate and the protective sheet can be stably suction-adhered and sheet-fed together at the same time.

What is claimed is:

1. A sucker capable of suction-adhering a printing plate and a protective sheet interposed between the sucker and the printing plate, the sucker comprising:

a main body portion integrally including a mounting base portion and including a suction-adherence surface; and a skirt portion attached at the suction-adherence surface side of the main body portion, said skirt portion being configured so as to closely correspond with the protective sheet during a suction-adherence operation of the printing plate, wherein the main body portion includes a predetermined stiffness for reducing deformation of the main body portion and preventing relative movement between the protective sheet and the printing plate during the suction-adherence operation; and wherein the skirt portion is configured with a predetermined resilience such that, during the suction-adherence operation, a surface of the skirt portion that closely corresponds with the protective sheet is substantially parallel to the suction-adherence surface of the main body portion.

2. The sucker of claim 1, wherein the suction-adherence surface comprises a surface including numerous minute protrusions and indentations.

3. The sucker of claim 1, wherein the skirt portion comprises an outer periphery capable of closely corresponding with the protective sheet during the suction-adherence operation.

4. The sucker of claim 1, wherein the suction-adherence surface comprises at least one of a sponge and a brush.

5. A sucker capable of suction-adhering a printing plate and a protective sheet interposed between the sucker and the printing plate, the sucker comprising:

a main body portion integrally including a mounting base portion and including a suction-adherence surface; and a skirt portion attached at the suction-adherence surface side of the main body portion, said skirt portion being configured so as to closely correspond with the protective sheet during a suction-adherence operation of the printing plate, wherein the main body portion includes a predetermined stiffness for reducing deformation of the main body portion and preventing relative movement between the protective sheet and the printing plate during the suction-adherence operation; and wherein, if a resilient force in the skirt portion in a suction direction, which intersects the suction-adherence surface, is $E_1$, a resilient force in the skirt portion in a direction parallel to the suction-adherence surface is $E_2$, a total component in the suction direction of a suction force during the suction-adherence operation is $P_1$, and a total component of this suction force parallel to the suction-adherence surface is $P_2$, then $$E_1<P_1 \text{ and } E_2>P_2.$$

6. A sucker capable of suction-adhering a printing plate and a protective sheet interposed between the sucker and the printing plate, the sucker comprising:

a main body portion integrally including a mounting base portion and including a suction-adherence surface; and a skirt portion attached at the suction-adherence surface side of the main body portion, said skirt portion being configured so as to closely correspond with the protective sheet during a suction-adherence operation of the printing plate, wherein the main body portion includes a predetermined stiffness for reducing deformation of the main body portion and preventing relative movement between the protective sheet and the printing plate during the suction-adherence operation; and wherein the sucker is configured such that when the sucker is suction-adhering the printing plate and protective sheet during the suction adherence operation, a gap t between the suction-adherence surface and the protective sheet is set in accordance with a resilient force in the skirt portion, a coefficient of friction between the skirt portion and the protective sheet, and stiffness of the protective sheet, and the gap t is set to a range such that the protective sheet will substantially not be drawn in toward the suction-adherence surface during the suction-adherence of the protective sheet;

wherein the sucker is configured such that when the sucker is suction-adhering the printing plate and protective sheet during the suction-adherence operation, the gap t formed between the suction-adherence surface and the protective sheet satisfies: $0 \leqq t \leqq 0.5$ mm.

* * * * *